US006199499B1

(12) United States Patent
Horais

(10) Patent No.: US 6,199,499 B1
(45) Date of Patent: Mar. 13, 2001

(54) MANUALLY OPERATED CATAMARAN VESSELS, STEERING APPARATUS FOR SUCH VESSELS AND METHOD OF STEERING SUCH VESSELS

(76) Inventor: Alan Horais, 7920 Rim Canyon Rd., Sunland, CA (US) 91040

( * ) Notice: Subject to any disclaimer, the term of this patent is extended or adjusted under 35 U.S.C. 154(b) by 0 days.

(21) Appl. No.: 09/391,810

(22) Filed: Sep. 8, 1999

Related U.S. Application Data

(60) Provisional application No. 60/099,566, filed on Sep. 9, 1998.

(51) Int. Cl.[7] ..... B63B 1/00

(52) U.S. Cl. ..... 114/162; 114/163

(58) Field of Search ..... 114/144 R, 61.1, 114/123, 162, 163

(56) References Cited

U.S. PATENT DOCUMENTS

| | | | | |
|---|---|---|---|---|
| 2,775,218 | * | 12/1956 | Kapusnyk | 114/163 |
| 3,331,350 | * | 7/1967 | Norton | 114/163 |
| 5,592,892 | * | 1/1997 | Kerckhoff | 114/163 |

* cited by examiner

*Primary Examiner*—Stephen Avila
(74) *Attorney, Agent, or Firm*—Ashen & Lippman

(57) ABSTRACT

A catamaran-type sailboat with a steering mechanism preferably located at the level of the catamaran deck. This steering mechanism may include a rotatable or generally linearly moveable pad or element. The pad is usually actuated by foot, leaving the users hands free to operate a sail, but it can also be actuated by hand. The movement of the pad is generally simultaneously transferred to rudders at the rear of each catamaran hull by a push-pull cable unit, thereby steering the sailboat. An elastic band attached to the pad keeps the steering mechanism self-centered when not in use. When the user wishes to maneuver the sailboat, he simply moves the pad in the proper direction with his foot or hand.

16 Claims, 6 Drawing Sheets

MANUALLY OPERATED CATAMARAN VESSELS, STEERING APPARATUS FOR SUCH VESSELS AND METHOD OF STEERING SUCH VESSELS

RELATED APPLICATIONS

This application is a Continuation-In-Part of U.S. Provisional application Ser. No. 60/099,566 filed Sep. 9, 1998.

FIELD OF THE INVENTION

The present invention relates generally to the construction of sailing vessels and more particularly to manually operable catamaran-type sailboats having rudders manually operated by the user to steer the sailboats.

BACKGROUND OF THE INVENTION

Catamaran type sailboats are well-known sailing vessels that by definition consist of a horizontal deck mounted on a pair of parallel hulls. The hulls are usually placed on opposite sides of the deck to provide a relatively stable craft. The use of the two hulls, spread apart, reduces the overall weight of the craft, thus increasing the overall speed.

The width of each hull is usually very narrow to reduce the amount of drag on the craft, again increasing the speed of the craft. The sails that propel the catamaran usually provide ample power to move the catamaran on any body of water such as a pond, lake, river or ocean.

Most catamarans are constructed as a three-piece unit with at least two tubular crossbeams that can be readily assembled by the user just prior to use. These crossbeams connect the two hulls above the waterline and the deck sits between the hulls on the crossbeams. While some larger catamarans are constructed in a unitary fashion, i.e., the deck is permanently fastened to the hulls, most catamarans are recreational vessels that are required to be transported to the place of use on the tops of automobiles, vans and the like. This generally requires the user to assemble the craft when he reaches his destination and then to disassemble the craft when finished.

The design of the catamaran permits its user to sit or stand on the deck while manipulating the sail with his hands. Generally, steering is accomplished by maneuvering the sail with the direction of the wind to propel the craft to the desired location. Most catamarans are also equipped with rudders or pivoting hull portions (herein "rudders") located at the stern of both of the hulls to aid in steering the craft. Generally, when one wished to make a slight maneuver with the catamaran, one merely turns a tiller or control element attached to both rudders to move the rudders in the proper direction. However, when a sharp and sudden turn is required, one must usually properly position the sail with the wind and simultaneously turn the rudders to accomplish a successful sharp turn. This type of turn requires substantial skill in order to do these steps simultaneously. A mistake on the part of the sailor can result in the catamaran flipping over.

In order to provide greater stability to the catamaran, another device, namely a daggerboard, centerboard or keel, is placed beneath the middle of each hull where it extends vertically down into the water to help prevent the catamaran from slipping sideways. The daggerboard, centerboard or keel is a long, flat board, which is placed with its broad surface parallel to the longitudinal axis of the hulls of the craft. The daggerboard, centerboard or keels are thus useful in reducing drift induced by the wind and sail interaction.

The daggerboard, centerboard, or keels are also helpful in "anchoring" the middle of the catamaran when making sharp turns. Without the centerboard, the catamaran is susceptible to so much lateral movement that the craft cannot be tacked upwind under extreme conditions.

It is important to note that catamarans typically utilize fixed rigging with masts tied to both hulls. As a result, catamarans tip to one side when sailed and are frequently sailed with one hull out of the water. This tilted attitude thus requires that each hull be equipped with a rudder and daggerboard, centerboard or keel.

Of particular concern are catamarans with rigging that can be adjusted to allow both hulls to remain in the water essentially without tipping to the side, and therefore, only one daggerboard, centerboard or keel between the hulls is required.

One of the major drawbacks in prior art catamarans is the difficulty in steering the craft. Generally, on larger sized catamarans, steering requires considerable sailing skills and expertise on the part of the user. This can be a serious drawback to the novice or intermediate sailor who lacks most of these necessary skills. The major problem in steering the catamaran is that the sailor usually has to use both hands to work the sail yet needs another hand to turn the tiller. On larger sized catamarans, the sail can be so difficult to manage that two people would be required to maneuver the boat: one to handle the sail and the other to steer the rudder. This can cause obvious problems to the user who wishes to sail alone.

The drawbacks in steering the catamaran are heightened if the user wishes to stand on the deck of the catamaran and sail the vessel much like a sailboard. Since a catamaran cannot be steered by shifting body weight and the sail, as can be done with a sailboard, a specific steering mechanism would be needed. Steering a rudder on each hull through a typical tiller or control element would be difficult since the user's hands would remain on the sail rigging during use. Therefore, another person would have to steer the rudders while the other person holds the sail. Therefore, there is a need for a new device that permits the user to simultaneously turn the rudders while holding the sail.

SUMMARY OF THE DISCLOSURE

While prior art catamaran sailing vessels are generally useful and fun to sail, these vessels have limitations and disadvantages as illustrated above which are serious drawbacks. The present invention has as an objective the elimination of these and other disadvantages by providing an improved steering apparatus or mechanism for operating the rudders. Preferably this steering mechanism can be operated by the user's foot. While this invention is related to all catamarans, it is of particular advantage to small catamarans that have the capability of rigging that can be tilted to windward thus allowing both hulls to remain in the water at all points of the sail (i.e. upwind, reaching and downwind). Steering that can be foot actuated is advantageous since it allows both hands to remain on the sail apparatus during use. Desirably, the steering mechanism is self centering so that when the rudders are not in use, they remain generally aligned in a front to rear position. The illustrated steering mechanism has a manually movable control element, pad or tiller designed to extend low over the aft surface of the deck where it is accessible to either of the user's hands or feet. By permitting one's feet to steer the craft, one can stand on the deck of the catamaran and use both hands in operating the sail assembly. By utilizing a means for maintaining the rudders in their aligned positions when the tiller is not being used, the vessel will sail in a straight course until such time as the user desires to turn the craft. The user can do this by simply moving the tiller with his feet.

One form of the present invention uses push-pull cables to connect the tiller or moveable pad with the rudders. A push-pull cable is a semi-rigid cable that slides inside a flexible tube. The ends of the tube are clamped solidly to the vessel at the length desired, while the cable is free to slide within the tube. The cable has a certain amount sticking out either end of the tube. By pushing or pulling the cable, linear motion is transferred from one end of the cable through the tube to the other end of the cable. These push-pull cables attach to the bellcranks on the outboard sides of the rudders. When the moveable pad or tiller is moved by foot or hand to the right, both rudders turn to the left, thereby turning the moving vessel to the left. When the moveable pad or tiller is moved by foot or hand to the left, the rudders turn to the right, thereby turning the moving vessel to the right. An elastic or biasing means, such as a spring or elastic rope or band, is attached to the end of the tiller or moveable pad and is fastened to a hook located on the deck portion of the boat. This elastic means keeps the rudders centered so that they remain in a straight front-to-rear position when no external forces are applied to the tiller or moveable pad. This permits the catamaran to sail in a straight course until the tiller is turned.

The push-pull cable actuation eliminates a complicated, multi-link mechanism. This allows the actuation to be very smooth and thereby more sensitive. There is a significant safety advantage also as there are fewer moving linkage parts to fall on then the mechanism is used with a wind-surfing type sail and rig or when the catamaran has lifted one hull from the water.

The result of using the tiller or moveable pad that hugs the surface of the rear of the deck produces a steering apparatus that can be used by one's foot in a steering the catamaran. This permits the user to utilize both his hands in operating the sail.

The push-pull cables connecting the tiller or moveable pad to the rudder bellcranks provide for a smoother operating, simpler and less expensive mechanism than is typical of the multi-link steering mechanism found on many current production catamarans. It will also be safer for the user who may step or fall on it.

BRIEF DESCRIPTION OF THE DRAWINGS

A complete understanding of the present inventions and other advantages and features thereof may be gained from a consideration of the following description of the preferred embodiments taken in conjunction with the accompanying drawings in which.

DETAILED DESCRIPTION OF PREFERRED EMBODIMENTS

Figure 1:
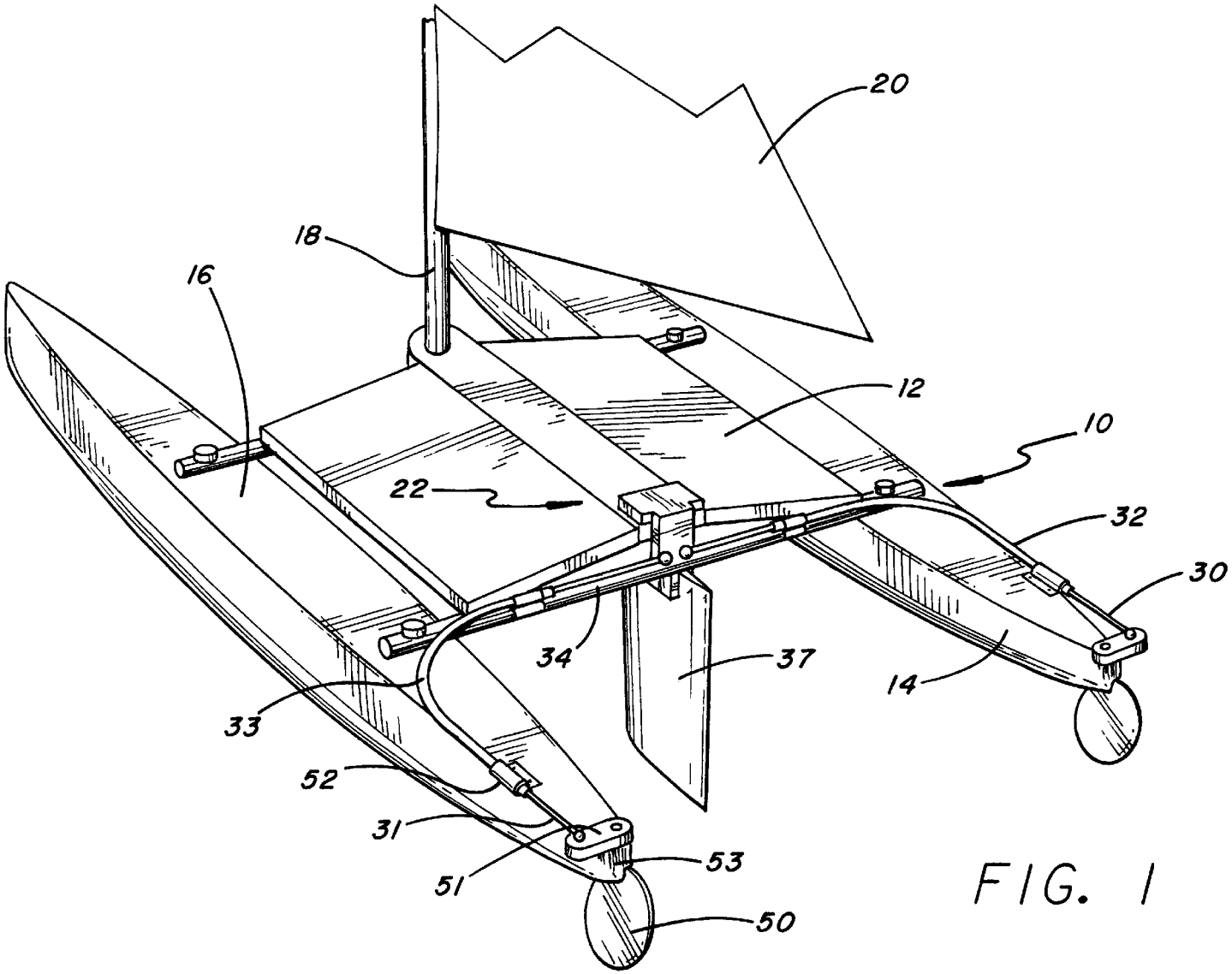
FIG. 1 is a perspective view of a preferred embodiment of the present invention with a sliding pad referred to a Version 1.

While the present inventions are susceptible of various modifications and alternative constructions, the embodiments shown in the drawings will herein be described in detail. It should be understood, however, that it is not the intention to limit the inventions to the particular forms disclosed; but on the contrary, the intention is to cover all modifications, equivalencies and alternative constructions falling within the spirit and scope of the inventions as expressed in the appended claims.

Referring initially to FIG. 1, a catamaran 10 is shown having a deck portion 12 and a par of parallel hulls 14 and 16 attached to the sides of the deck. A mast 18 with a sail 20 is mounted near the bow of the deck. A sliding pad steering mechanism 22 in accordance with Version 1 of the present invention is shown as it is mounted on the aft end of the deck 12.

Figure 2:
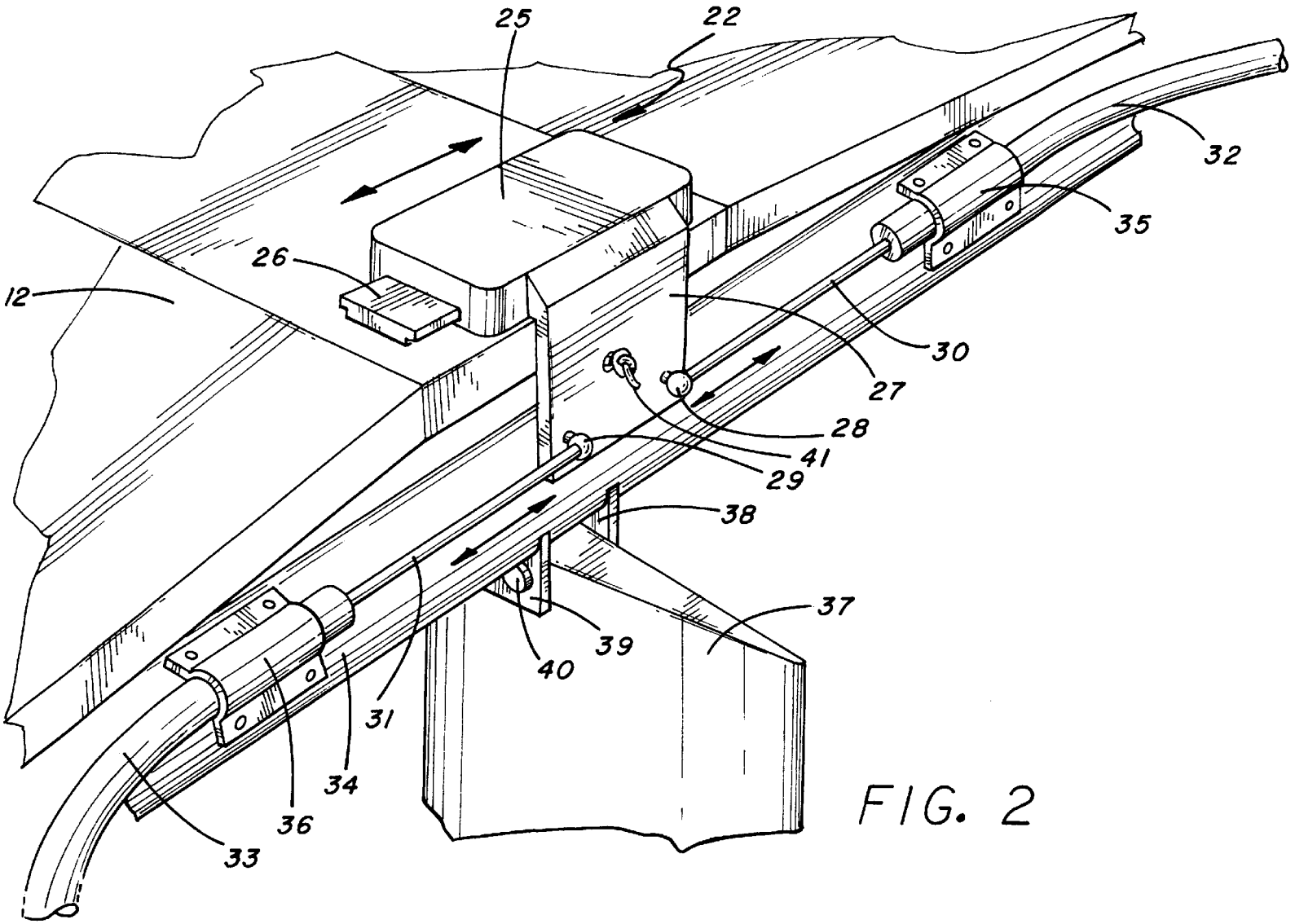
FIG. 2 is a perspective view of the sliding pad mechanism of Version 1 of the present invention.

Referring now to FIGS. 1 and 2, the advantageous Version 1 sliding pad steering mechanism 22 used in connection with the catamaran is shown. The sliding pad 25 slides in a linear bushing 26 made from a low friction material. The sliding pad 25 has a vertical tab 27 off the rear face to which the universal connections 28 and 29 for the push-pull cables 30 and 31 are attached. The tubes for the push-pull cables 32 and 33 are attached to the crossbeam 34 by brackets 35 and 36. The centerboard 37 pivots off tabs 38 and 39 that are welded to the crossbeam 34. A pivot pin or fastening device 40 connects the tabs 38 and 39 to the centerboard 37. The sliding pad 25 is self-centering due to the action of biasing means in the form of an elastic band 41 pulled through a hole in the tab 27. The elastic band 41 is tied in a knot while the other end is attached to an eyelet 42 underneath the deck 12. The sliding pad 25 moves back and forth on the linear bushing 26, moving the push-pull cables 30 and 31 back and forth with it as the pad 25 is connected by the vertical tab 27 to the cables through the universal connections 28 and 29.

Figure 3:
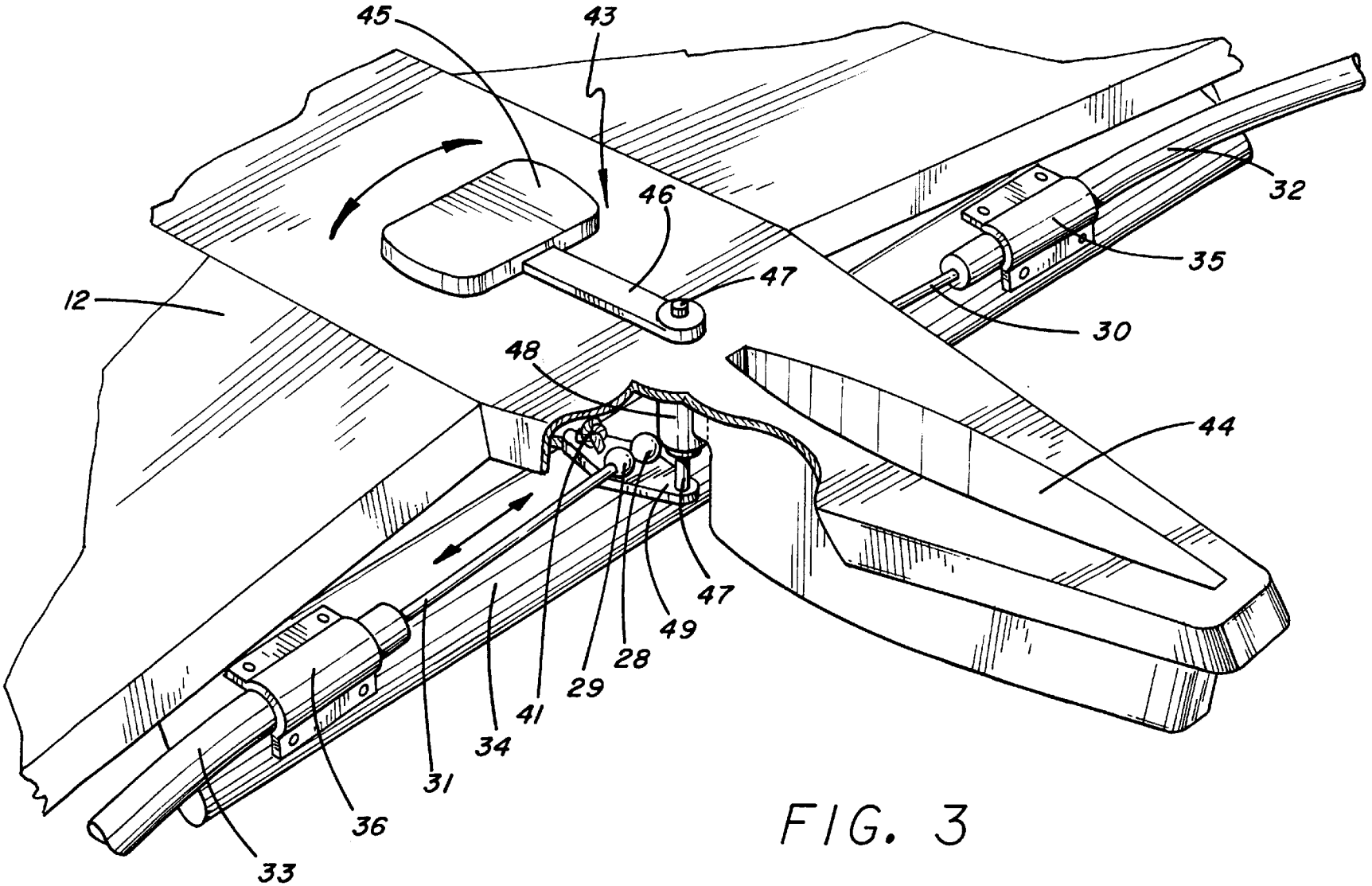
FIG. 3 is a perspective of the low tiller and pad mechanism of another preferred embodiment of the present invention referred to as Version 2. The deck part is partially cut away how the steering mechanism under the deck.

Referring now to FIG. 3, a perspective view of Version 2 of the present invention is shown. It a variation of the deck 12 with a tiller mechanism 43 pivotally mounted to the deck 12. The deck has been extended aft to incorporate a daggerboard slot 44 in which a typical sailboat daggerboard slides. This replaces the centerboard 37 in Version 1 and tabs 38 and 39. The tiller mechanism consists of a foot or hand pad 45, connecting arm 46, a shaft 47 pivotally mounted through a bushing 48 in the deck part 12. The lower end of the shaft 47 is connected to a bellcrank 49 that pivots side to side as the pad 45 pivots back and forth on the connecting arm 46. An elastic cord 41 is tied through a hole in the front of the bellcrank 49. The other end of the elastic cord is died to an eyelet 42 attached to the underside of the deck 12. This elastic cord 41 provides a self-centering action to the tiller mechanism 43. Pivoting the pad 45 back and forth moves the bellcrank 49 in an identical motion thereby moving the push-pull cables 30 and 31 through the universal connections 28 and 29 that are mounted on the bellcrank 49.

The elastic cord 41 in Version 1 and Version 2 keeps the rudders in both steering mechanisms aligned and parallel to the longitudinal axes of the hulls when the steering mechanism is not being moved by the user.

Figure 4:
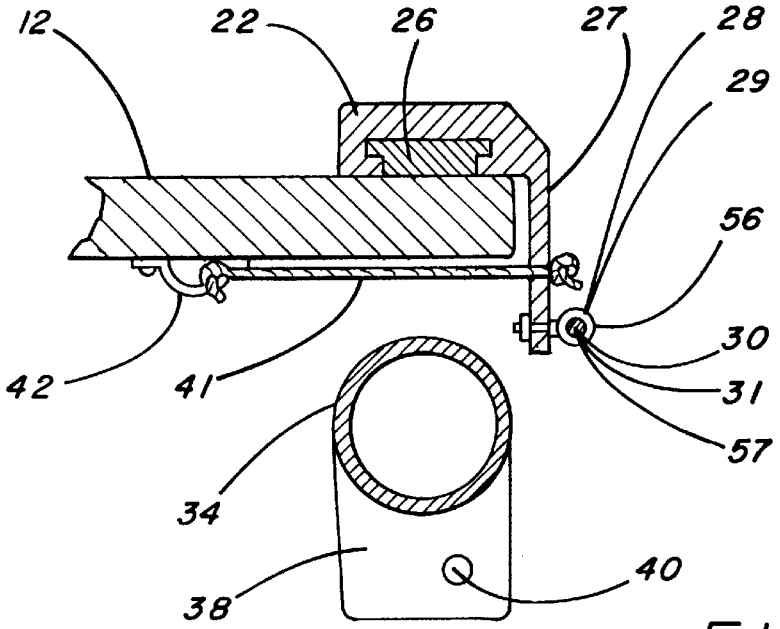
FIG. 4 is a cross-section of Version 1 of the present invention showing details of the sliding mechanism.
Figure 5:
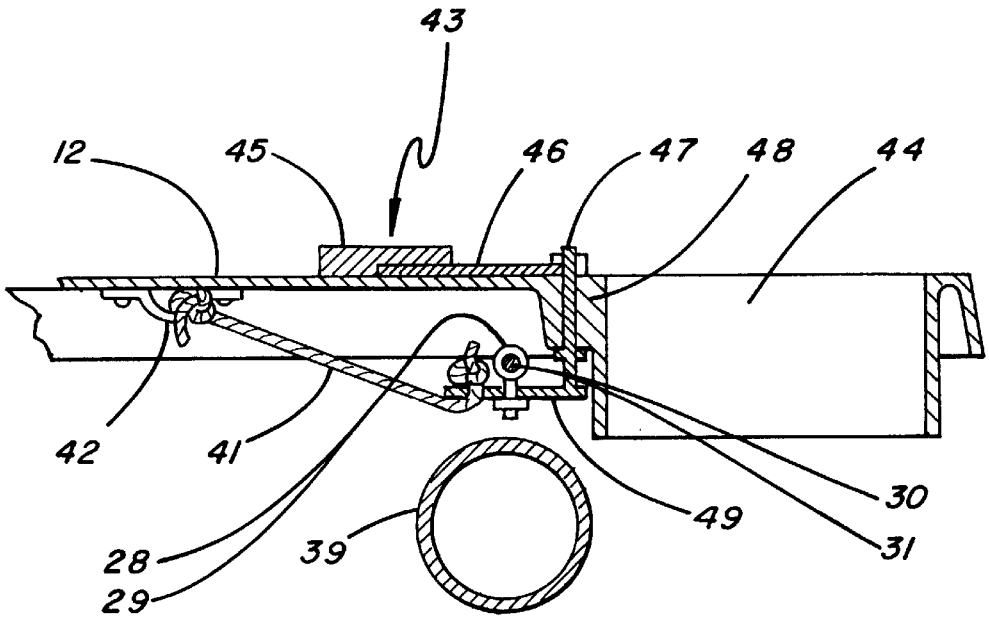
FIG. 5 is a cross-section of Version 2 of the present invention showing details of the tiller and pad mechanism.

FIGS. 4 and 5 are cross sections of Version 1 and Version 2 of the advantageous steering mechanisms and show details of the steering mechanisms. FIG. 4 is Version 1 and FIG. 5 is Version 2.

FIG. 4 shows the relationship of the sliding pad 22 to the linear bushing 26 and their overall relationship to the deck part 12. The relationship of the deck part 12 to the rear crossbeam 34 is also shown. It can be seen that vertical tab 27 off the sliding pad 22 is used as a connecting point for the elastic cord 41 and the push-pull cables 30 and 31 through the universal connections 28 and 29.

FIG. 5 shows the relationship of the tiller mechanism to the deck part 12 and the rear crossbeam 34. The tiller mechanism consists of a hand or footpad 45, a connecting arm 46, a shaft 47, and a bellcrank 49 to which the universal connections 28 and 29 are attached. These universal connections actuate the push-pull cables 30 and 31. The elastic cord 41 for self-centering has one end tied through a hole in the bellcrank 49, the other end is tied to an eyelet 42 on the underside of the deck 12. The deck part 12 extends past the tiller mechanism 43 to form a slot 44 for the daggerboard.

Figure 6:
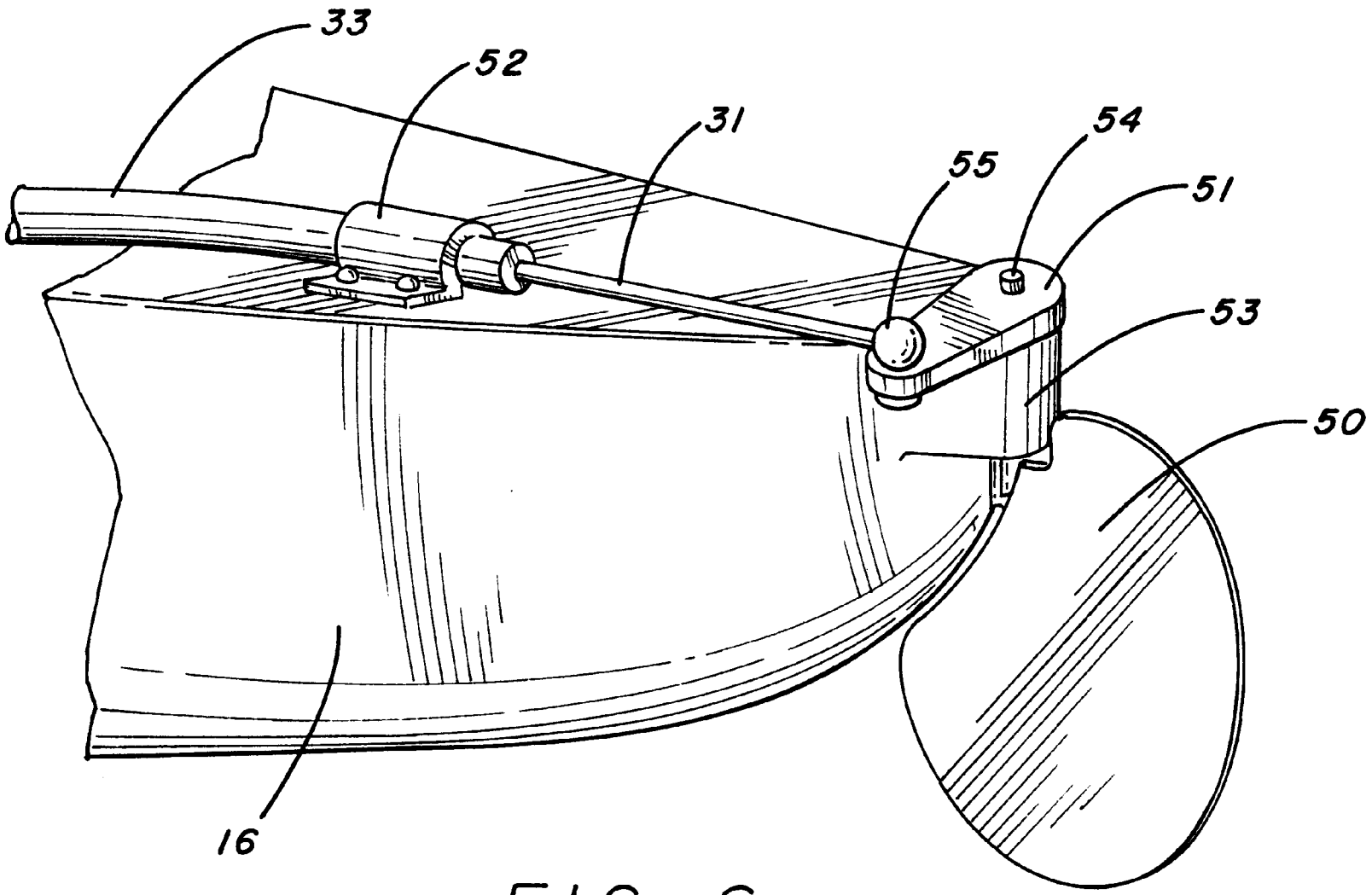
FIG. 6 is a perspective of the rudder and bellcrank mechanism at the aft end of the left hull. This shows the push-pull tube attachment to the hull and the cable attachment to the rudder bellcrank. The rudder and bellcrank mechanism on the right hull is identical except that the bellcrank and push-pull cable assemblies are on the right side of the hull (i.e., just opposite of the left hull).

FIG. 6 shows the relationship of the rudder 50 of the left hull to the rudder bellcrank 51, the push-pull cable 31, the push-pull tube 33 a mounting bracket 52 and the left hull 16. Also shown are the rudder shaft 54 and a universal connection 55 for the push-pull cable. The rudder shaft 54 is mounted pivotally through a bushing 53 molded into the rear end of the hull part 16. Forward or backward linear motion of the push-pull cable 31 pulls or pushes the rear bellcrank 51; this in turn rotates the rudder 50 through the rudder shaft 54 around a vertical axis, thus steering the vessel.

Figure 7:
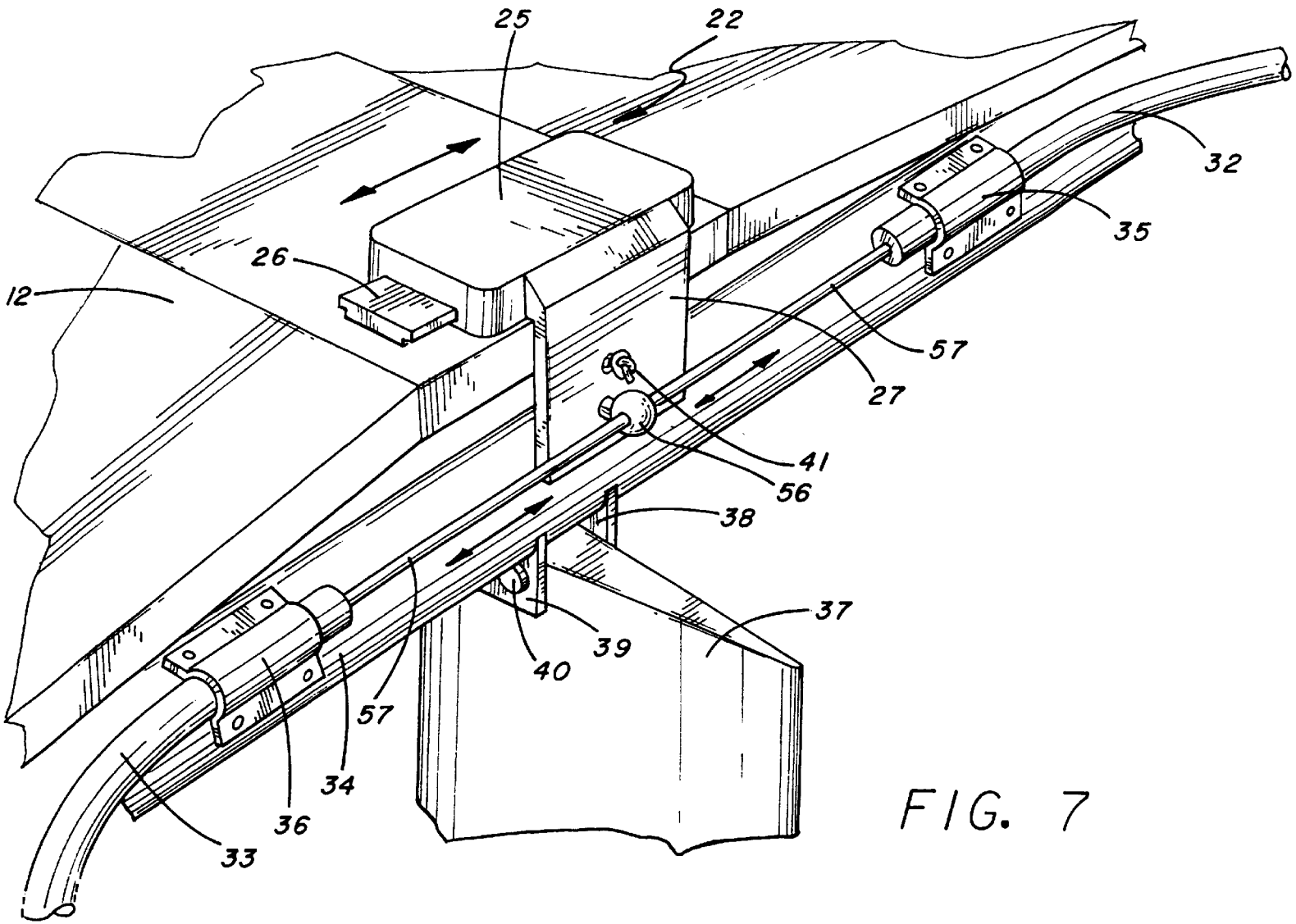
FIG. 7 is a perspective view of a sliding pad mechanism similar to that of Version 1 of FIG. 2, but where there is a single section cable instead of the pair of cables of FIG. 2.

FIG. 7 illustrates an alternative presently preferred form of the invention. FIG. 7 is similar to FIG. 2, except that the cables or cable sections 30, 31 are replaced by a single cable section 57. The cable section 57 extends in sliding relation through an opening or passageway in a connector 56. The connector 56 is secured to the sliding pad 22 for common side-to-side movement.

Thus, the push-pull cable unit that connects to the rudders may be comprised of a single cable or cable section 57, or a plurality of cables or cable sections 30, 31.

In the preferred embodiments the sliding rudder, tiller and rudder parts can be made of a rigid plastic by common molding, vacuum forming roto-molding or fiberglass. The shaft and bellcrank for Version 2, the tiller mechanism, can be made of metal, as also should be the rudder shaft and rudder bellcrank. The push-pull cable system and all its mounting hardware can be purchased at a marine supply store as control cables for powerboats.

When the user wants to execute a turn, he merely pushes the tiller or pad in the proper direction. When the tiller or pad is not being used, the elastic band keeps the tiller of pad aligned with the centerline of the deck. The catamaran will then proceed in a straight course until it is ready to be maneuvered. Thus, this advantageous sliding pad or tiller steering system allows the user to use both hands to control the sail and yet have the option of steering the vessel with his foot when appropriate.

Thus, there has been illustrated and described a unique hand or foot steering mechanism for a catamaran type sailboat. This mechanism can take the form of a sliding pad or a pad on a tiller. The movement is transferred to the rudders by push-pull cables attached to the sliding pad or tiller on one end and the rudders on the other. It fulfills all the objects and advantages set forth. It should be understood that many changes, modifications, variations and other uses and applications will be come apparent to those skilled in the art of after considering this disclosure and accompanying drawings. Therefore, any and all such changes, modifications, variations and other uses and applications which do not depart from the spirit and scope of the inventions are deemed to be covered by the inventions.

What is claimed is:

1. A manual operable catamaran-type sailboat having a sail, a pair of spaced apart floatable hulls, a deck extending between the hulls for supporting a user, a pair of rudder mechanisms that each have a rudder rotatable about a generally upright axis, one rudder mechanism being located generally at the rear of each of the hulls, and steering apparatus comprising:

a) an elongated push-pull cable mechanism comprising a support-guide defining an elongated guide pathway and an elongated cable unit of a single cable section extending along said pathway and longitudinally movable in both directions along said pathway, said cable section having opposite ends, each of said cable section ends being connected to one of said rudder mechanisms so that longitudinal movement of the cable section acts to generally simultaneously rotate both rudders to generally the same angle so as to steer the sailboat, and b) a manually operable control mechanism supported on the sailboat and having a manually movable control element, said control element being in position to be accessible to and movable by a user on the deck, said control element being operatively connected to said cable unit so that movement of said element by the user imparts desired longitudinal movement to the cable section, rotation of the rudders, and resultant steering of the sailboat.

2. The steering apparatus of claim 1 wherein said manually moveable control element is pivotable about a generally upright axis.

3. The steering apparatus of claim 2 wherein said control element is located at about the level of the sailboat deck to facilitate movement of the element by the foot of the user.

4. he steering apparatus of claim 1 wherein said control element is moveable generally linearly from side to side.

5. The steering apparatus of claim 4 wherein said control element is located at about deck level to facilitate movement of the element by the foot of the user.

6. The steering apparatus of claim 1 wherein said elongated guide pathway for said cable unit describes a generally curved path extending at its ends from adjacent to each of the rudders to a point generally centered forwardly of said rudders.

7. The steering apparatus of claim 1 wherein said control mechanism includes self-centering biasing means that tends to maintain said cable unit generally centered so that the rudders are maintained generally aligned front-to-rear until said control mechanism is operated.

8. A manually operable catamaran-type sailboat having a sail, a pair of spaced apart floatable hulls, a deck extending between the hulls for supporting a user, a pair of rudder mechanisms that each having a rudder rotable about a generally upright axis, one rudder mechanism being located generally at the rear of each of the hulls, and steering apparatus comprising a) a single elongated push-pull cable supported on the sailboat, said cable being connected at each end to one of the rudder mechanisms so that longitudinal movement of the cable acts to generally simultaneously rotate the rudders of the rudder mechanisms to generally the same angle so as to steer the sailboat, and b) a manually operable control mechanism supported on said sailboat and having a manually movable control element, said control element being in position to be accessible to and movable by a user on the deck, said control element being operatively connected to the cable, the movement of said element by the user imparting desired longitudinal movement to said cable, movement of the rudders, and resultant steering of the sailboat.

9. A method of sailing and steering a manually operable catamaran-type sailboat that has a sail, a pair of spaced apart front-to-rear extending floatable hulls, a deck extending between the hulls for supporting a user, a pair of rudder mechanisms each with a rudder tiltable about a generally upright axis, one rudder mechanism being located at the rear end of each hull, and a steering apparatus that comprises a) an elongated push-pull cable mechanism comprising a support-guide defining an elongated guide pathway and an elongated cable unit of a single cable section extending along the pathway and longitudinally movable in both directions along the pathway, the cable section having opposite ends, each of the cable section ends being connected to one of the rudder mechanisms so that longitudinal movement of the cable unit acts to generally simultaneously rotate both rudders to generally the same angle so as to steer the sailboat, and b) a manually operable control mechanism supported on the sailboat and having a manually movable control element, the control element being in position at about the level of the deck and so as to be accessible to and movable by a user on the deck, the control element being operatively connected to said cable unit so that movement of the element by the user imparts desired longitudinal movement to the cable section, rotation of the rudders, and resultant steering of the sailboat, said method comprising:

a) the user standing upon the deck and operating the sail with her hands, and b) the user generally simultaneously moving the steering control member one way or the other with her foot to steer the sailboat.

10. A manually operable catamaran-type sailboat that has a sail, a pair of spaced apart front-to-rear extending floatable hulls, a deck extending between the hulls for supporting a user, a pair of rudder mechanisms each with a rudder tiltable about a generally upright axis, one rudder mechanism being located at the rear end of each hull and, a steering apparatus that comprises a) an elongated push-pull cable mechanism comprising a support-guide defining an elongated guide pathway and an elongated cable unit of a single cable section extending along said pathway and longitudinally movable in both directions along said pathway, said cable section having opposite ends, each of said cable section ends being connected to one of said rudder mechanisms so that longitudinal movement of the cable section acts to generally simultaneously rotate both rudders to generally the same angle so as to steer the sailboat, and b) a manually operable control mechanism supported on the sailboat and having a manually movable control element, said control element being in position to be accessible to and movable by a user on the deck, said control element being operatively connected to the cable unit so that movement of said element by the user imparts desired longitudinal movement to the cable section, rotation of the rudders, and resultant steering of the sailboat.

11. The sailboat of claim 10 wherein said manually moveable control element is pivotable about a generally upright axis.

12. The sailboat of claim 11 wherein said control element is located at about the level of the deck to facilitate movement of the element by the foot of the user.

13. The sailboat of claim 10 wherein said control element is moveable generally linearly from side to side.

14. The sailboat of claim 13 wherein said control element is located at about deck level to facilitate movement of the element by the foot of the user.

15. The sailboat of claim 10 wherein said elongated guide pathway for said cable unit describes a generally curved path extending at its ends from adjacent to each of the rudders to a point generally centered forwardly of said rudders.

16. The sailboat of claim 10 wherein said control mechanism includes self-centering biasing means that tends to maintain said cable unit generally centered so that the rudders are maintained generally aligned front-to-rear until said control mechanism is operated.

* * * * *